US010123636B2

(12) United States Patent
Nicolopulos et al.

(10) Patent No.: US 10,123,636 B2
(45) **Date of Patent: *Nov. 13, 2018**

(54) MERCHANDISE DISPLAY SYSTEM

(71) Applicant: KRATOS ENTERPRISES HOLDINGS, LLC, St. Clair Shores, MI (US)

(72) Inventors: Stephen Nicolopulos, Belmont, CA (US); John Gunther, Belmont, CA (US); Thomas A. Moeller, Belmont, CA (US)

(73) Assignee: KRATOS ENTERPRISES HOLDINGS, LLC, St. Clair Shores, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/840,433

(22) Filed: Dec. 13, 2017

(65) Prior Publication Data

US 2018/0110347 A1 Apr. 26, 2018

Related U.S. Application Data

(63) Continuation of application No. 15/079,517, filed on Mar. 24, 2016, now Pat. No. 9,861,214, which is a continuation of application No. 11/941,835, filed on Nov. 16, 2007, now Pat. No. 9,345,354, which is a (Continued)

(51) Int. Cl.

| | |
|---|---|
| ***A47F 5/00*** | (2006.01) |
| ***A47F 7/00*** | (2006.01) |
| ***A47F 5/02*** | (2006.01) |
| ***A47F 5/04*** | (2006.01) |
| ***A47G 25/12*** | (2006.01) |

(Continued)

(52) U.S. Cl.

CPC ..... *A47F 7/0028* (2013.01); *A47F 5/02* (2013.01); *A47F 5/04* (2013.01); *A47F 5/05* (2013.01); *A47G 25/12* (2013.01); *A61H 2003/0255* (2013.01); *A61H 2003/0261* (2013.01)

(58) Field of Classification Search

CPC ..... A47F 7/0028; A47F 7/0021; A47F 5/02; A47F 5/04; A47F 5/05; A47G 25/12; B65D 85/00; B65D 85/08; B65D 75/00; B65D 75/04; B65D 75/06; B65D 75/30

See application file for complete search history.

(56) References Cited

U.S. PATENT DOCUMENTS

| | | | | |
|---|---|---|---|---|
| 478,646 | A | 7/1892 | Sencenbaugh | 211/62 |
| 929,897 | A | 8/1909 | Taylor | 211/70 |
| 1,065,381 | A | 6/1913 | Martin | 211/65 |

(Continued)

*Primary Examiner* — Daniel J Rohrhoff

(74) *Attorney, Agent, or Firm* — Christopher P. Maiorana, PC

(57) ABSTRACT

An apparatus comprising a center slot and a plurality of openings. The center slot may physically connect to a support structure. The plurality of openings may be positioned around a periphery of the apparatus. Each of the openings (a) has a vertical slot and an elongated cavity and (b) removably accepts an attachment device. The elongated cavity is tapered from top to bottom. An insertion member that is tapered from a top of the attachment device to a bottom of the attachment device is accepted by one of the plurality of openings to fit in the elongated cavity. A segment of the attachment device is configured to pass through the vertical slot when the insertion member is inserted into the elongated cavity.

7 Claims, 7 Drawing Sheets

Related U.S. Application Data continuation-in-part of application No. 11/701,759, filed on Feb. 2, 2007.

(51) Int. Cl.
*A47F 5/05* (2006.01)
*A61H 3/02* (2006.01)

(56) References Cited

U.S. PATENT DOCUMENTS 1,525,330 A 2/1925 Smith ..... 312/135
1,761,088 A * 6/1930 Pryde ..... A47F 5/04 211/163
3,136,426 A * 6/1964 Sakuma ..... A47G 25/12 211/62
3,195,736 A 7/1965 Bomar, Jr. ..... 211/163
3,661,270 A 5/1972 Lucci et al. ..... 211/62
3,685,661 A 8/1972 Kimmel ..... 211/64
3,826,378 A 7/1974 Novak ..... 211/170.5
3,874,512 A 4/1975 Wegley et al. ..... 211/163
3,968,882 A * 7/1976 Mello ..... A47B 96/00 211/182
4,094,417 A * 6/1978 Cairnes ..... A47B 47/03 108/192
4,300,742 A 11/1981 Hunn ..... 248/229.26
4,359,161 A 11/1982 Sinoff ..... 206/315.11
4,493,416 A 1/1985 Steinman ..... 206/315.1
4,614,272 A 9/1986 Shelton et al. ..... 211/163
4,696,447 A * 9/1987 Strecker ..... A45D 20/12 248/206.3
4,753,446 A 6/1988 Mills ..... 280/47.18
4,899,877 A 2/1990 Kiernan ..... 206/349
4,946,034 A 8/1990 Matsubara ..... 206/315.11
4,951,440 A * 8/1990 Staeger ..... E04B 1/1909 403/171
4,961,555 A * 10/1990 Egan, Jr. ..... A47G 23/0225 211/41.2
5,018,622 A 5/1991 Hartley ..... 206/461
5,060,814 A 10/1991 Oglesbee ..... 206/470
5,137,243 A * 8/1992 Stevens ..... A47G 25/12 248/316.7
5,439,269 A * 8/1995 Cheng ..... A47C 4/02 108/150
5,485,919 A 1/1996 Samberg ..... 206/278
5,586,664 A 12/1996 Taylor ..... 211/58
5,673,718 A * 10/1997 Kennedy ..... A45B 3/00 135/16
5,673,802 A 10/1997 Valentino ..... 211/70
5,676,261 A 10/1997 Baughman et al. ..... 211/70
5,772,050 A * 6/1998 Shih ..... B41K 1/58 211/163
5,842,567 A 12/1998 Rowe et al. ..... 206/364
5,849,378 A 12/1998 Gask ..... 16/225
5,918,490 A * 7/1999 Lion ..... A63B 55/408 206/315.3
6,305,534 B1 * 10/2001 Neal ..... F41B 5/063 206/315.11
6,308,838 B1 10/2001 Endean ..... 211/37
6,330,945 B1 12/2001 Reimer ..... 206/461
6,585,119 B2 * 7/2003 Palder ..... A47F 5/02 211/163
6,626,305 B2 9/2003 Domenig et al. ..... 211/144
6,955,280 B2 * 10/2005 Saitoh ..... B60R 11/0241 224/197
6,971,613 B2 12/2005 Shendelman ..... 248/150
7,784,607 B1 8/2010 Thomas ..... 206/0.8
8,141,719 B2 * 3/2012 Hopper ..... A47F 7/0028 211/163
9,345,354 B2 * 5/2016 Nicolopulos ..... A47F 5/02
9,861,214 B2 * 1/2018 Nicolopulos ..... A47F 7/0028
2003/0015486 A1 * 1/2003 Chen ..... A47F 5/02 211/70
2004/0056030 A1 3/2004 Coppedge ..... 220/4.23
2005/0096664 A1 5/2005 Cohn et al. ..... 606/108
2005/0133557 A1 * 6/2005 McKenzie ..... B60R 11/00 224/547
2007/0278166 A1 * 12/2007 Morton ..... A01K 97/08 211/70.8
2008/0061016 A1 * 3/2008 Nicolopulos ..... A47F 5/02 211/62
2008/0185354 A1 * 8/2008 Hopper ..... A47F 5/02 211/62
2009/0294622 A1 * 12/2009 Medders ..... A47B 81/04 248/523
2010/0170862 A1 * 7/2010 Poisson ..... A63D 15/10 211/68
2010/0213147 A1 * 8/2010 Hopper ..... A47F 5/02 211/62
2011/0253652 A9 * 10/2011 Nicolopulos ..... A47F 5/02 211/62

* cited by examiner

FIG. 7
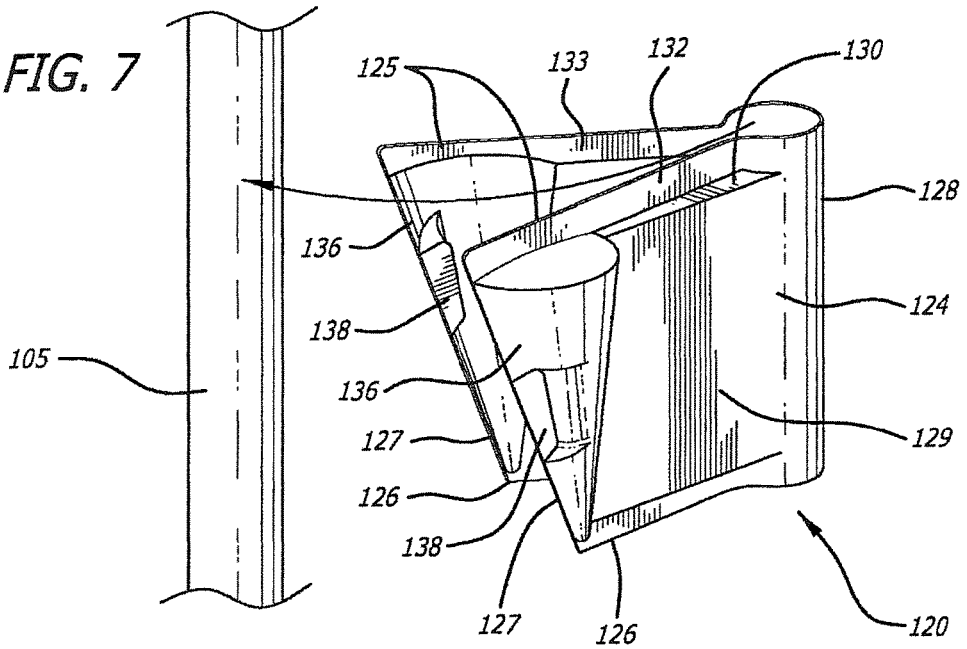
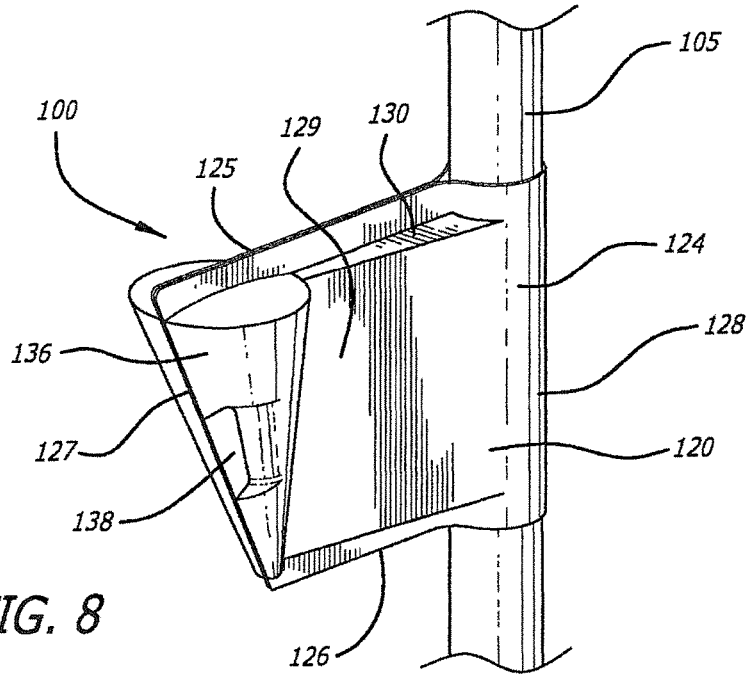
FIG. 8

MERCHANDISE DISPLAY SYSTEM

This application relates to Ser. No. 15/079,517, filed Mar. 24, 2016, which relates to U.S. Ser. No. 11/941,835, filed Nov. 16, 2007, now U.S. Pat. No. 9,345,354, which relates to Ser. No. 11/701,759, filed Feb. 2, 2007, each of which are hereby incorporated by reference in their entirety.

FIELD OF THE INVENTION

The present invention pertains to systems, methods, apparatuses and components thereof for facilitating the display of merchandise, e.g., in a retail store.

BACKGROUND

Typically, a customer goes to a retail store for a particular purpose, i.e., to purchase particular items or to find items that will satisfy particular needs. Once the customer enters the store, however, in addition to attempting to sell those specific items, the store has a financial incentive to induce the customer to purchase other items as well. Therefore, retail stores are greatly interested in packaging and display systems that will attract a customer's attention to other products it is selling.

The individual displays often are provided by the manufacturer or supplier of such products and, of course, those entities also have a significant financial incentive to attempt to increase impulse purchases of the displayed products. While the interests of the store, on the one hand, and the manufacturer or supplier, on the other, align in this respect, in other respects their interests are different. For example, although the manufacturer or supplier generally would like to obtain as much floor or wall space as possible for their products, the retail stores usually try to confine such space as much as possible, so that they can accommodate a greater variety of different products. Accordingly, display systems that provide the greatest marketing effect within the smallest amount of floor or shelf space are highly desirable.

A variety of different packaging and display systems exist. One of the most common uses a stiff, thin, clear plastic container, often configured as a "clamshell" package. The product is enclosed within a plastic package which is hinged along one edge, thus resembling a clamshell. During the packaging operation, the clamshell package is closed around or through the product, and the other three edges are sealed shut. One side of the clamshell package frequently is provided with a hole, so that the entire clamshell-packaged product can be hung in a kind of horizontal stack, together with identical items, from a horizontally extending rod.

While such packaging/display systems are useful for certain types of products, especially smaller products, they generally do not work well for larger products. For example, walking canes frequently are not packaged so that potential purchasers can hold them, try them and look at them closely. A common technique for displaying walking canes in a retail store is to simply place them into an umbrella holder, typically a canister with an open top. This arrangement does not afford the customers easy examination or evaluation of the product, let alone attracting their attention.

SUMMARY

The present invention addresses this problem by providing, inter alia, systems for displaying merchandise, e.g., in a retail store, as well as by providing various individual components of such systems. In the preferred embodiments of the invention, a display system includes a display apparatus and matching merchandise assemblies. More preferably, the display apparatus includes a number of openings, and each merchandise assembly includes an item of merchandise having an attachment device fastened to it, with the attachment device including an insertion member that can be removably inserted into any one of the openings in the display apparatus. Still more preferably, the insertion member is vertically oriented when disposed within one of such openings, is rigid, is tapered and holds the item of merchandise at a distance away from the display apparatus in a vertical orientation.

Thus, in one aspect the invention is directed to a system for displaying merchandise, which includes a support structure, a receptacle physically connected to the support structure and having a plurality of openings around its periphery, and a plurality of merchandise assemblies. Each merchandise assembly, in turn, includes an item of merchandise and an attachment device fastened to the item of merchandise. The attachment device has a vertically oriented insertion member that is tapered from top to bottom and is removably inserted into one of the plurality of openings in the receptacle.

In another aspect, the invention is directed to a system for displaying merchandise, which includes a support structure having a plurality of openings and a plurality of merchandise assemblies. Each merchandise assembly, in turn, includes an item of merchandise and an attachment device fastened to the item of merchandise. The attachment device has a vertically oriented insertion member that is tapered from top to bottom and is removably inserted into one of said plurality of openings, whereby each merchandise assembly is supported by the support structure. In addition, each said item of merchandise is elongated and is substantially vertically oriented when suspended from the receptacle.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE FIGURES

FIG. 7 is a perspective view illustrating how an attachment device is fastened to an elongated item of merchandise according to a representative embodiment of the present invention;

FIG. 8 is a perspective view illustrating an attachment device fully fastened to an elongated item of merchandise according to a representative embodiment of the present invention;

DETAILED DESCRIPTION OF THE EMBODIMENTS

The following description generally refers to particular preferred embodiments of the present invention. In addition, in some cases certain variations are described. However, it should be understood that the following embodiments are exemplary only and should not be taken as limiting.

Display Apparatuses

Figure 1:
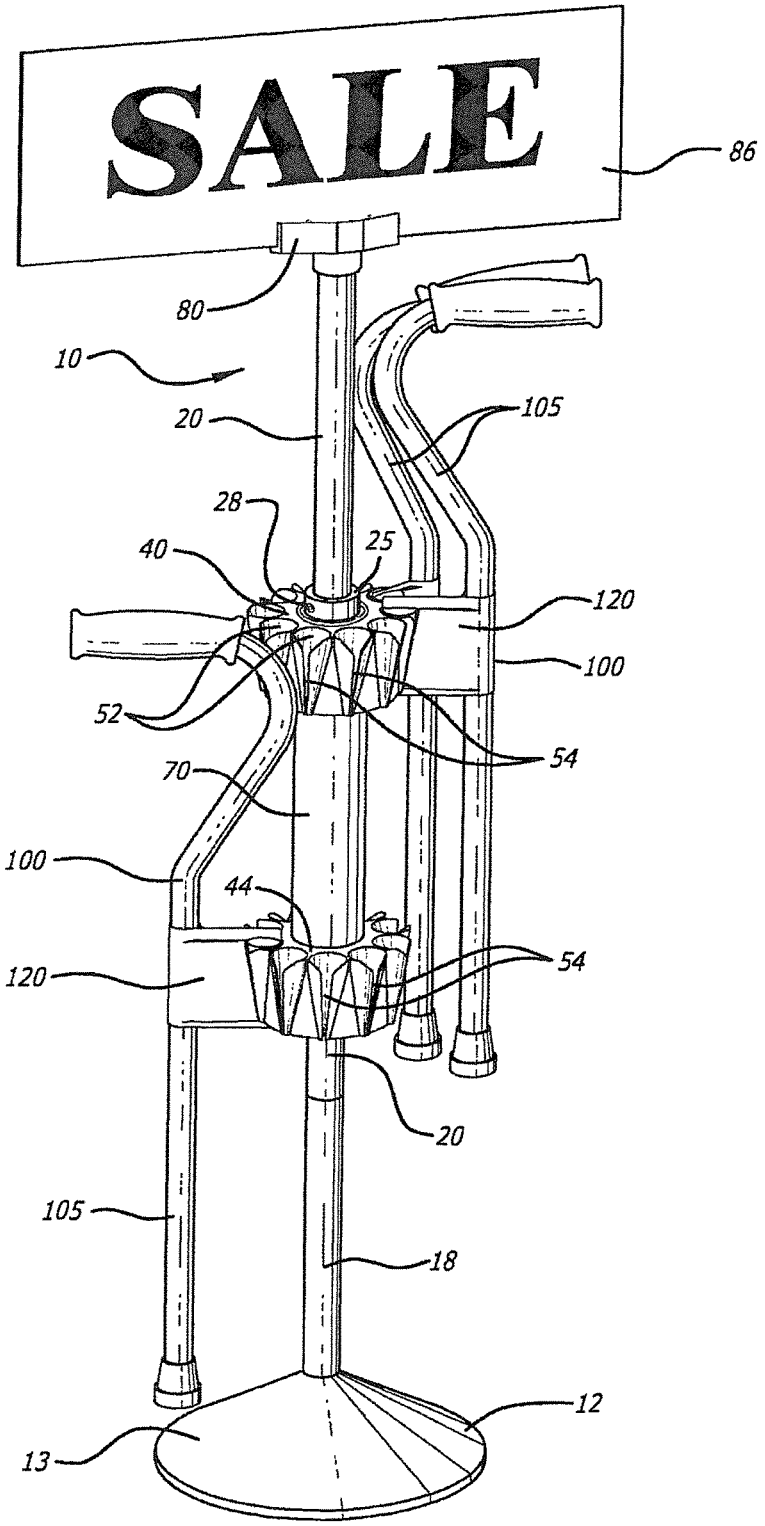
FIG. 1 is a perspective view of a display apparatus holding three merchandise assemblies according to a representative embodiment of the present invention.

Referring to FIG. 1, a display apparatus 10 is shown according to a representative of embodiment of the present invention includes a base portion 12, a central supporting pole 20, an upper collar 25, a lower collar 26, an upper receptacle 40, a lower receptacle 44, and a connecting piece 70. In addition, a top cap 80 may be provided at the top of the central supporting pole 20 for supporting a sign 86.

Figure 2:
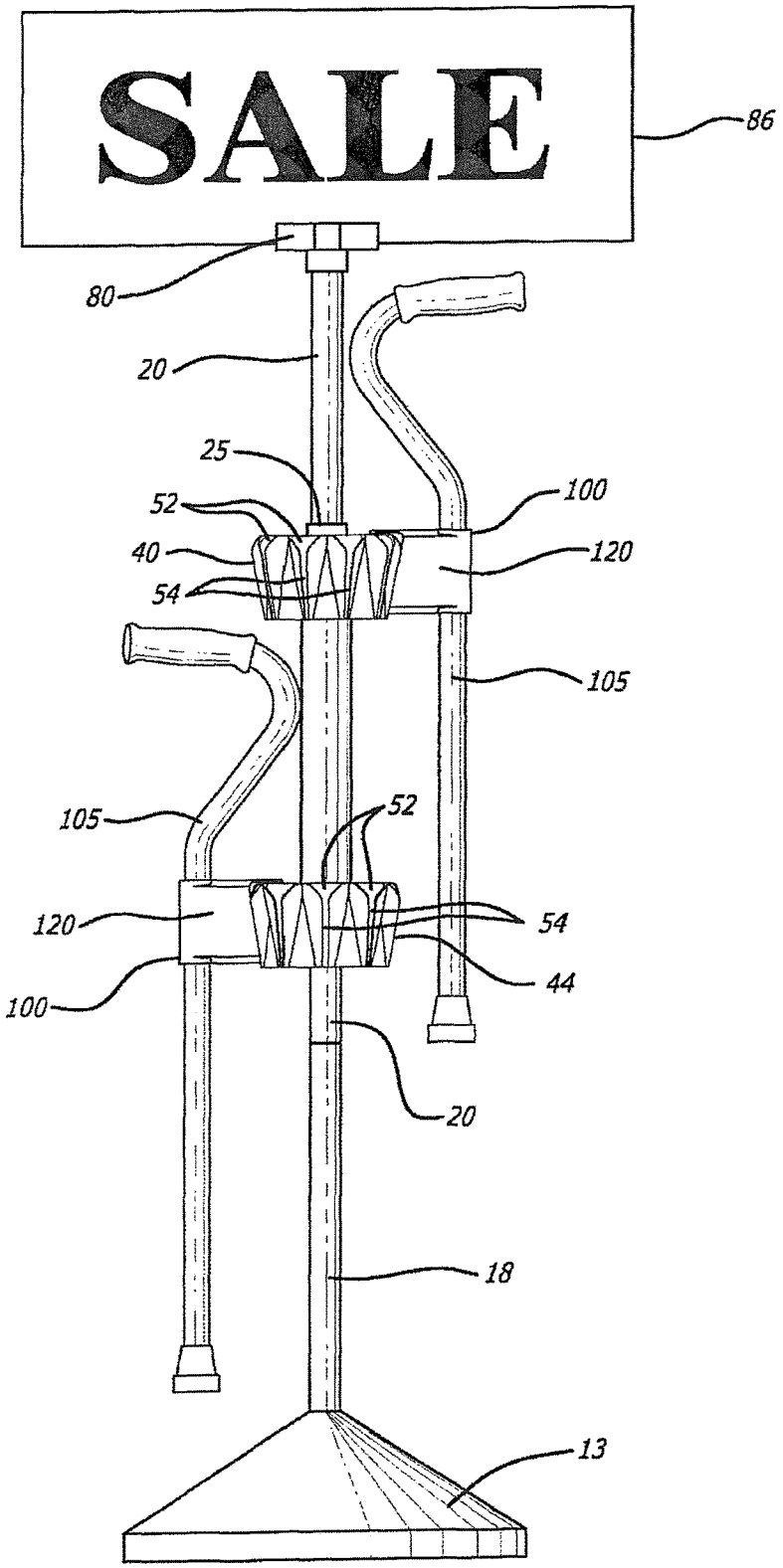
FIG. 2 is a front elevational view of a display apparatus holding two merchandise assemblies according to a representative embodiment of the present invention.

Referring to FIG. 2, base portion 12 includes a plastic bottom portion 13 that is shaped as a solid, truncated cone. Bottom portion 13 preferably is approximately 16 inches in diameter and, in the present embodiment, is approximately 4 inches high. One example is the commercially available MY-D® 16 Base. However, other bases that provide adequate stability instead can be used, including bases that have radially extending legs rather than a solid structure.

Figure 3:
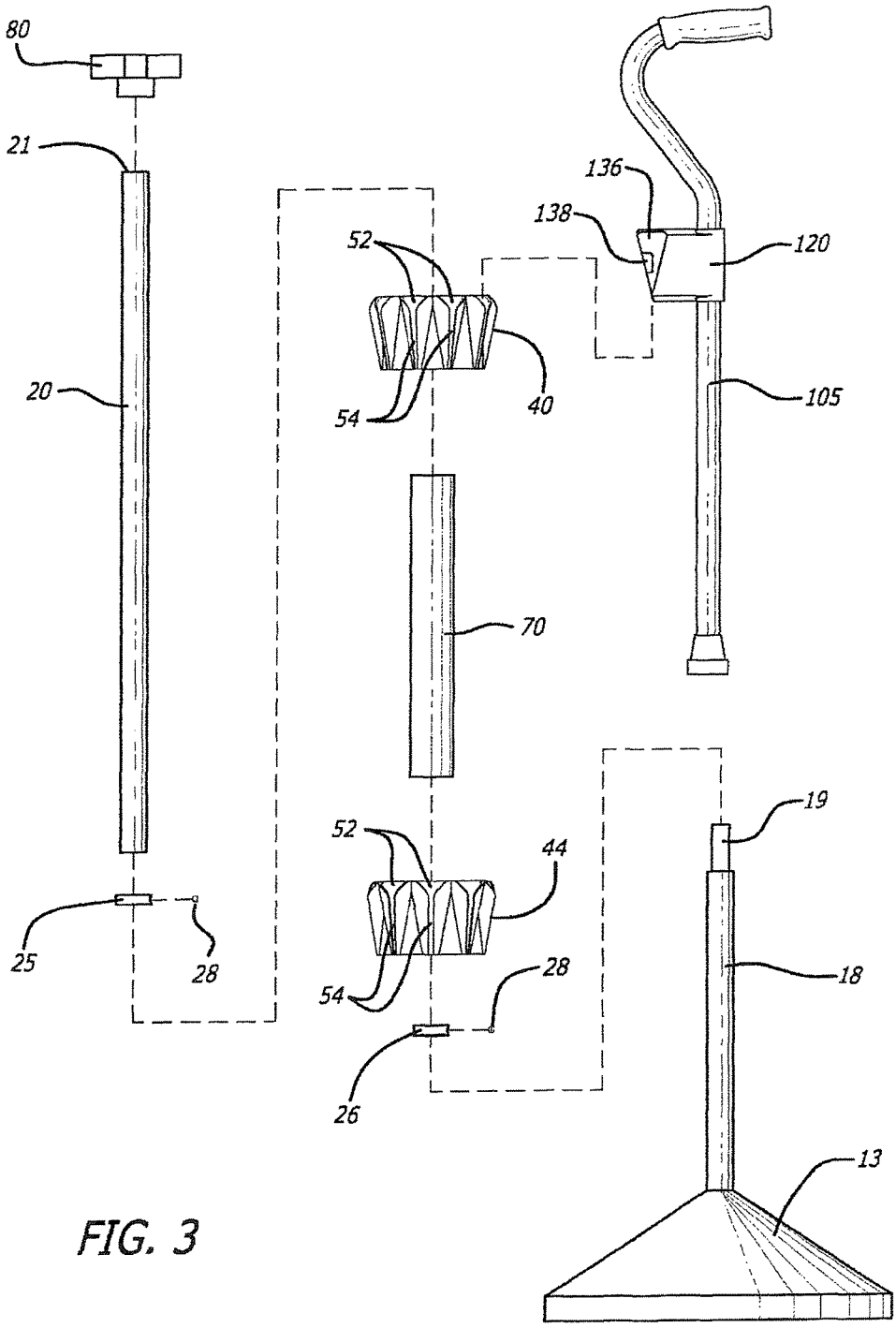
FIG. 3 is an exploded view of a display apparatus and a single merchandise assembly according to a representative embodiment of the present invention.

Referring to FIG. 3, a pole 18 extends vertically from the flat top surface 14 of the bottom portion 13. In the present embodiment, pole 18 is configured as metal tubing having a uniform diameter (e.g., approximately 1 inch) along most of its length but narrowing somewhat (e.g., by approximately ⅛ inch) at its top segment 19 (e.g., the top 2 inches of its length). The entire length of pole 18 from the top surface 14 of bottom portion 13 preferably varies depending upon the particular embodiment, but may be, e.g., from 18-26 inches, with a typical length being 22 inches.

Central supporting pole 20, which serves as the main support for the functional structure of display apparatus 10, has the same diameter as the main portion of pole 18 and fits snugly over the top segment 19 of pole 18. Collars 25 and 26 define the limits of such functional structure. In the present embodiment of the invention, collars 25 and 26 are identical to each other, and each is secured to supporting pole 20 using a set screw 28. In alternate embodiments, collars 25 and 26 are attached to supporting pole 20 using glue, screws, pins, or any combination of the foregoing.

In order to construct display apparatus 10, central supporting pole 20 first is installed onto base pole 18, e.g., by simply sliding it on. Next, bottom collar 26 slides onto central supporting pole 20 from the top end 21 of supporting pole 20 and then is secured to central supporting pole 20 at the desired location.

Lower receptacle 44 then slides onto central supporting pole 20 (again, from its top and 21) until lower receptacle 44 abuts bottom collar 26. It is noted that the central hole 50 in lower receptacle 44 is slightly larger than the outer diameter of central supporting pole 20 so that lower receptacle 44 slides and rotates easily on pole 20.

Figure 4:
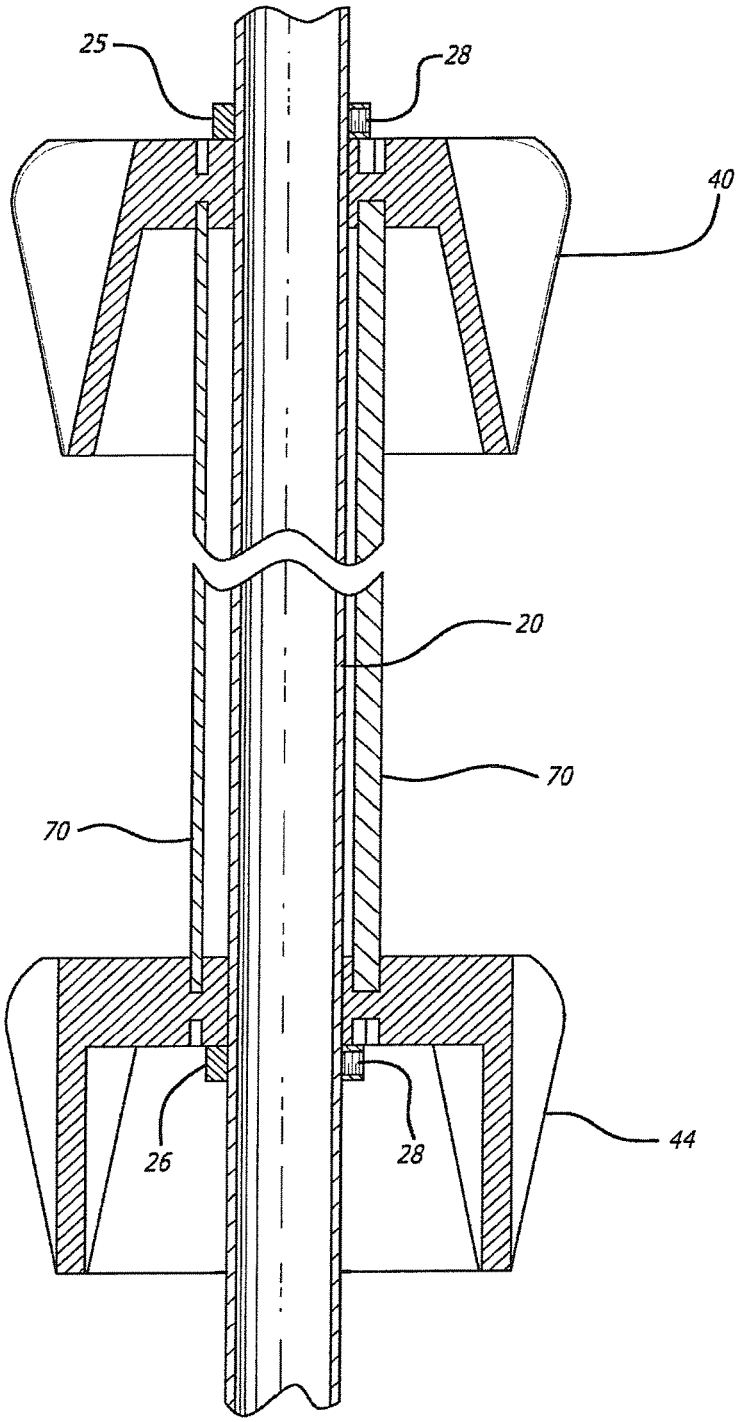
FIG. 4 is a cross-sectional view of the central portion of a display apparatus according to a representative embodiment of the present invention.
Figure 5:
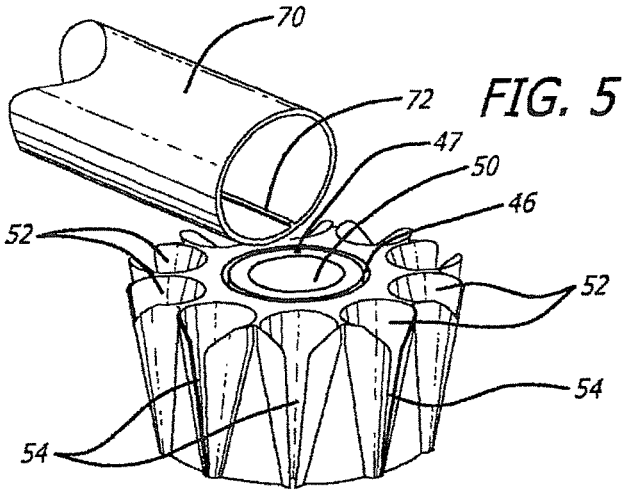
FIG. 5 is a perspective view of a receptacle and the end portion of a connecting tube according to a representative embodiment of the present invention.

Thereafter, referring to FIG. 4, connecting piece 70 (which preferably is primarily a hollow cylinder or tube having a significantly greater diameter than central supporting pole 20) is maneuvered over central supporting pole 20 until it engages lower receptacle 44. In the present embodiment, referring to FIG. 5, connecting piece 70 includes a narrow but elongated tab 72 extending inwardly from its inner surface along its entire length, and lower receptacle 44 includes a slot 46 in its top surface with a corresponding alignment notch 47 at the inner border of slot 46. More preferably, slot 46 is shaped (e.g., circular in the present case) and dimensioned (e.g., having a diameter of approximately 2 inches in the present case) so as to just accommodate the bottom end of connecting piece 70 and alignment notch 47 is shaped and dimensioned so as to just accommodate tab 72.

Accordingly, when constructing display apparatus 10, after connecting piece 70 initially contacts lower receptacle 44, the two components are rotated relative to each other until tab 72 engages (slides into) alignment notch 47. The use of tab 72 and alignment notch 47 allows a fairly precise rotational alignment between lower receptacle 44 and connecting piece 70. However, any of a variety of other techniques may be used to facilitate such rotational alignment, such as: notching connecting piece 70 and providing a tab on slot 46 of lower receptacle 44, shaping the two ends so that they only fit together at a single rotational alignment, or simply marking the two components so that the assembler knows how to align them. Nevertheless, while simple marking is possible, the provision of an alignment mechanism generally will tend to better facilitate assembly. Providing alignment notch 47 on connecting piece 70 and elongated tab 72 on slot 46 is particularly preferred, partly because the components can be easily implemented, e.g., by injection molding lower receptacle 44 to include alignment notch 47 and extruding connecting piece 70 so as to include elongated tab 72.

Next in the assembly process, upper receptacle 40 slides onto central supporting pole 20 (again, from its top and 21) until upper receptacle 40 contacts connecting piece 70. Like the top surface of lower receptacle 44, the bottom surface of upper receptacle 40 preferably includes a slot 42 with a corresponding alignment notch 43 at its inner border. Also, slot 42 preferably is shaped (again, circular in this case) and dimensioned so as to just accommodate the top end of connecting piece 70 (which in this case is identical to its bottom end) and alignment notch 43 is shaped and dimensioned so as to just accommodate tab 72. Accordingly, after upper receptacle 40 initially contacts connecting piece 70, the two components are rotated relative to each other until tab 72 engages (slides into) alignment notch 43. Once again, it should be noted that any other techniques may be used for facilitating the rotational alignment between connecting piece 70 and upper receptacle 40.

Figure 9:
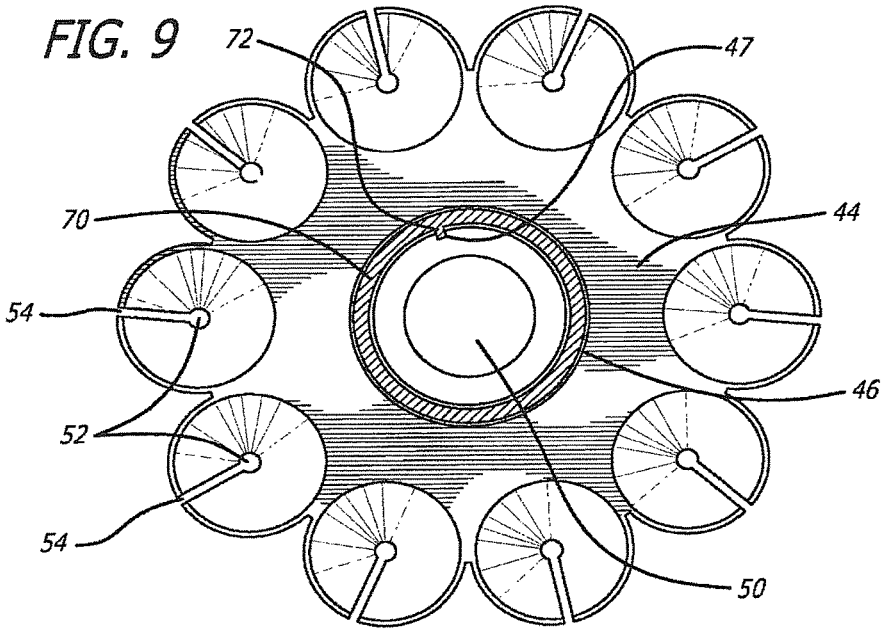
FIG. 9 is a cross-sectional view of a lower receptacle with a connecting tube inserted into its upper receiving slot according to a representative embodiment of the present invention.
Figure 10:
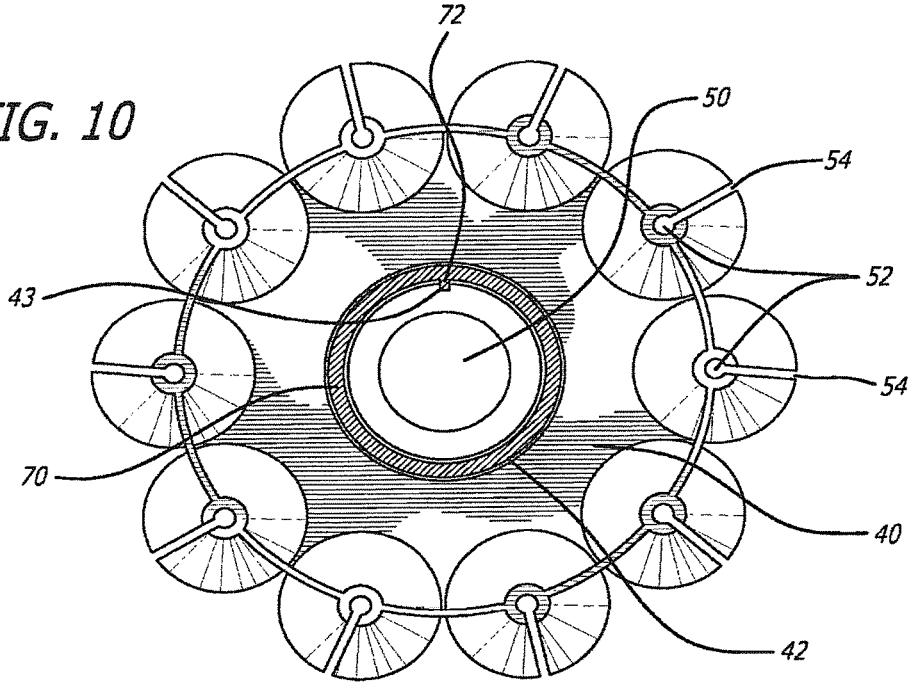
FIG. 10 is a cross-sectional view of an upper receptacle with a connecting tube inserted into its lower receiving slot according to a representative embodiment of the present invention.

Referring to FIG. 9 and FIG. 10, in the preferred embodiments, receptacles 40 and 44 are identical to each other. Therefore, in such embodiments each of receptacles 40 and 44 includes a central hole 50, a lower slot 42 and a lower alignment notch 43 in its bottom surface and an upper slot 46 and an upper alignment notch 47 in its top surface. As a result of making receptacles 40 and 44 identical, parts inventories can be reduced and a single injection mold can be used to produce both, thereby lowering costs. For ease of reference, the following discussion sometimes only refers to receptacle 40. However, as noted above, lower receptacle 44 preferably is structurally identical to upper receptacle 40.

In the present embodiment, receptacle 40 includes ten openings 52 that are identical to each other and are equally spaced around the perimeter of receptacle 40 (i.e., at 36° intervals). Each such opening 52 preferably is configured as a tapered cavity, with a larger opening at the top and narrowing further down. More preferably, each such opening 52 is configured essentially as an inverted cone with a longitudinal slot 54 along the center of its outer face (through the outside diameter of receptacle 40).

Figure 6:
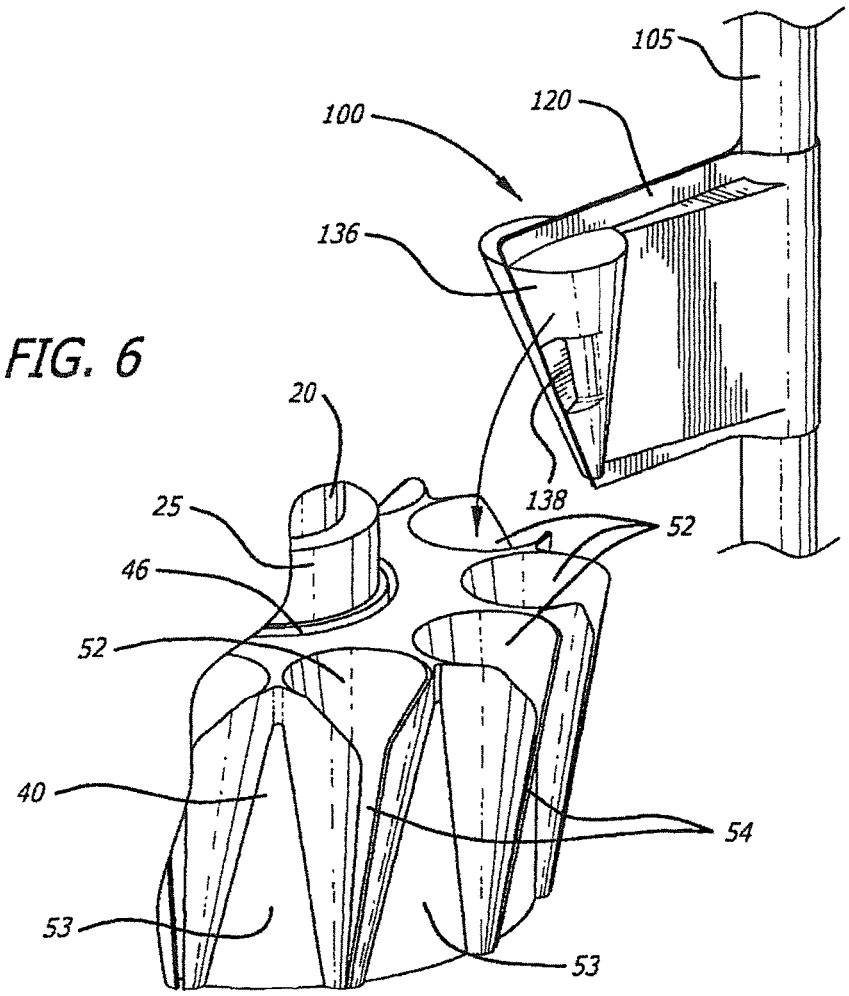
FIG. 6 is a perspective view illustrating how an insertion member is inserted into an opening in a receptacle according to a representative embodiment of the present invention.

The alignment notches 43 and 47 (in receptacles 40 and 44) preferably are positioned such that the openings 52 in the upper receptacle 40 are rotationally offset from the openings 52 in the lower receptacle 44. Referring to FIG. 6, more preferably, such sets of openings 52 are offset as much as possible, i.e., with the openings 52 in one centered on the partitions 53 between the openings 52 in the other. In the foregoing example in which ten openings 52 are provided in each of receptacles 40 and 44, the offset is 18°. That is, the alignment notch 47 in each of receptacles 40 and 44 is 18° offset from its alignment notch 43. In this regard, it is noted that, because in the present embodiment elongated tab 72 is located at the same angular position at each end of connecting piece 70, the fixed angular offset between upper receptacle 40 and lower receptacle 44 is determined solely by the relative angular offset between the alignment notches 43 and 47, respectively.

Returning to the assembly process, after upper receptacle 40 has been installed down over central supporting pole 20 and rotated into position against the top end of connecting piece 70, upper collar 25 slides onto central supporting pole 20 until it contacts upper receptacle 40. At that point, its set screw 28 is tightened to lock it into position.

At this point, lower receptacle 44 is fixedly attached to connecting piece 70 which is fixedly attached to upper receptacle 40. That is, the engagement of elongated tab 72 with alignment notches 43 and 47 means that rotation of any one of these three components (around central supporting pole 20) will cause the other two to rotate as well, and the secure attachment of collars 25 and 26 and the direct contact between adjacent components prevents any significant upward or downward movement of lower receptacle 44, connecting piece 70 or upper receptacle 40. Preferably, however, the spacing between upper collar 25 and upper receptacle 40 is sufficient to permit the entire assembly of lower receptacle 44, connecting piece 70 and upper receptacle 40 to rotate freely, albeit as a unit.

Finally, the plastic top cap 80 is inserted onto the top end 21 of central supporting pole 20. Preferably, cap 80 is held in place by a compression fit or by using a set screw. In the preferred embodiments, top cap 80 is provided with a slot 82 (or any other mounting structure) for holding a sign 86, typically a sign 86 that describes or promotes the items of merchandise 105 held by display apparatus 10.

In the foregoing embodiment, each of the openings 52 in the receptacles 40 and 44 is used for holding a different merchandise assembly 100, as described in more detail below. Thus, the display apparatus 10 of the foregoing embodiment (having two receptacles 40 and 44 that are rotationally offset from each other, each having ten openings 52) permits up to 20 items of merchandise 105 to be displayed. Moreover, each of the receptacles 40 and 44 is free to rotate about supporting pole 20, allowing a customer to have easy access to all of the items of merchandise 105, even if the display apparatus 10 is located in a corner of the store or close to a wall. It is noted that the particular physical connection of receptacles 40 and 44 to central supporting pole 20 in the foregoing embodiment of the invention permits receptacles 40 and 44 to be rotated around central supporting pole 20 without the use of ball bearings or other complicated structures.

In alternate embodiments of the invention, the receptacle (e.g., receptacle 40 or a different receptacle having some other shape that includes openings 52 or other kinds of openings) is physically connected to the support structure (e.g., pole 20 or some other structure, such as a wall or other flat surface) in any other manner. For example, one or more receptacles may be bolted to, otherwise fixedly attached to, or even integrally formed with the provided support structure. Thus, for example, in one alternate embodiment openings 52 (or other kinds of openings) are integrally formed into a wall or other fixed or generally immovable surface. In another alternate embodiment, a plurality of openings (or other kinds of openings) are arranged on a central support at different distances from the support, as well as different angular or horizontal offsets, thereby providing diversity in depth as well as angular or horizontal diversity, with a resulting potential ability to support a greater number of items 105.

Attachment Devices

Referring to FIG. 6, the other main component of a merchandise display system according to the preferred embodiments of the present invention is an attachment device 120, which fastens to an item of merchandise 105 and allows the item of merchandise 105 to be held by or suspended from the display apparatus 10. The combination of an attachment device 120 and an item of merchandise 105 is referred to herein as a "merchandise assembly" 100.

In the preferred embodiments of the invention, the attachment device 120 is configured as a transparent, semi-rigid plastic clamshell structure, although in alternate embodiments it can be, e.g., semi-transparent, translucent, substantially rigid and/or entirely rigid. However, unlike conventional clamshell structures, attachment device 120 in the preferred embodiments of the invention has a unique shape. One example of such a clamshell-type attachment device 120 is most clearly illustrated in FIGS. 7 and 8. In this embodiment, attachment device 120 has three different portions: a fastening portion 124, a pocket portion 129 and an insertion member 136.

Referring to FIG. 7, in the present embodiment, the fastening portion 124 is in the central section of the attachment device 120 when attachment device 120 is in its open state (i.e., prior to use). The particular attachment device 120 illustrated in the drawings is for use with a walking cane (i.e., the item of merchandise 105 in this example). Accordingly, fastening portion 124 in this example is a flat (or substantially flat) section that can be it or has been folded into a semi-cylindrical shape.

That flat section is tightly wrapped around the cane's main shaft, and then the resulting front panel 131 and rear panel 132 are joined together along the resulting three edges (top edge 125, bottom edge 126 and inner edge 127) in order to close attachment device 120 around the subject item of merchandise 105. For this purpose, one may use glue, staples or a welding technique. Alternatively, the edges 125-127 may be provided with tabs and corresponding notches that snap fit together. It is noted that the folding of attachment device 120 around fastening portion 124 in this embodiment of the invention also creates the outer edge 128 of the attachment device 120. In order to prevent attachment device 120 from sliding or otherwise moving relative to the item 105, it often will be preferable to use one or more small pieces of transparent tape to adhere it to the item of merchandise 105. Alternatively, it is possible to include a stop on the item 105 and/or to locate attachment device 120 near an existing bump, spring-loaded pin or other existing feature that can function as a stop.

The pocket portion 129 preferably has a square or other rectangular shape. In certain embodiments, e.g., where just a single sheet of paper or card is to be inserted, pocket portion 129 is simply a flat extension of the fastening portion 124. Alternatively, in order to insert into pocket portion 129 a booklet or other material with any significant thickness, pocket portion 129 preferably is created by forming the section(s) of the front panel 131 and/or the rear panel 132 that are to comprise pocket portion 129 with an offset 130, e.g., as illustrated in FIGS. 7 and 8.

Referring to FIG. 8, insertion member 136 preferably has a tapered shape which is wider on top and narrower toward the bottom. More preferably, insertion member 136 is shaped primarily as an inverted cone. However, if the cone is to be hollow, as is the case with the clamshell structure of the current embodiment, then a perfect cone generally would lack adequate strength. For this purpose, a flattened notch 138 preferably is formed into the inner edge 127 of insertion member 136.

In the present embodiment of the invention, the various components have the following dimensions. Connecting piece 70 is cylindrical and has a diameter of approximately 2 inches and a length of approximately 12¾ inches. Accordingly, slots 42 and 46 in receptacle 40 are circular and also have a diameter of approximately 2 inches. Central supporting pole 20 has a diameter of approximately 1 inch and is approximately 30½ inches long. Receptacle 40 has a diameter of approximately 4¾ inches, and each of the openings 52 has a diameter of approximately 1 inch at its top end and a length of approximately 2⅞ inches. Display apparatus 10 preferably is approximately 5-7 feet tall and, when fully loaded with merchandise assemblies 100, has a width of not more than 20 inches, more preferably, not more than 18 inches, and even more preferably not more than 16 inches, including the merchandise assemblies 100.

A number of aspects of the attachment device 120 described above can be varied in alternate embodiments of the invention. For example, in certain cases the item of merchandise 105 (or portion thereof) to which attachment device 120 is to be fastened is not smooth and cylindrical, as is the walking cane in the previous example. In such alternate cases, the fastening portion 124 preferably is shaped to match the portion of the item 105 to which it is to be fastened. Moreover, by shaping fastening portion 124 to the particular item 105, the attachment device 120 often will be less likely to slide or otherwise move relative to the item of merchandise 105, even without a separate stop on the item 105.

Configuring fastening portion 124 so that it is capable of simply wrapping around the merchandise item 105 generally is preferable for certain types of items 105, such as walking canes, pool cues, golf clubs, baseball bats, certain umbrellas and the like. However, for other types of items 105, such as certain small telescoping umbrellas with small handles, wrapping a fastening portion 124 around any portion of the item 105 might unduly interfere with the ability of a customer to inspect or try out the product 105. In such cases, using such a wraparound clamshell configuration for attachment device 120 might not be appropriate or ideal. Instead, a similar shape preferably is used for the attachment device 120, but the outer edge 128 of attachment device 120 preferably is provided with a clip, hook, loop, Velcro, snap or other fastening device that is appropriate for the portion of the item 105 to which attachment device 120 is to be fastened.

In any event, attachment device 120 preferably is rigid, or at least substantially rigid, enabling the merchandise item 105 to be held at a preferred distance and orientation with respect to display apparatus 10.

Merchandise Display System

With the display apparatus 10 assembled and appropriate attachment devices 120 fastened to various items of merchandise 105, each such merchandise assembly 100 can be suspended from display apparatus 10 by simply inserting the corresponding insertion member 136 into one of the openings 52 in one of the receptacles 40 and 44. As noted above, the insertion member 136 preferably is tapered from its top toward its bottom. In addition, the size of the openings 52 preferably is approximately the same as the size of the top of the insertion member 136. Because the insertion member 136 preferably also is tapered, its bottom is relatively small as compared to the opening 52, thereby facilitating the placement of insertion member 136 into opening 52.

Still further, in the preferred embodiments of the invention both the individual openings 52 and the insertion member 136 taper smoothly (e.g., having a primarily cone-shaped configuration). As result, once insertion member 136 is partly inside of an opening 52 it will typically slide easily the rest of the way into the opening 52.

Moreover, vertical slot 54 in opening 52 preferably accommodates the relatively narrower portion of attachment device 120 just past insertion member 136 (e.g., the pocket portion 129 or a thin strip between insertion member 136 and pocket portion 129). Accordingly, slot 54 functions as a guide, keeping merchandise assembly 100 at a desired angle (e.g., 90 degrees) relative to display apparatus 10, while simultaneously permitting attachment device 120 to extend out from opening 52 when insertion member 136 is fully inserted into opening 52.

Although slot 54 can be omitted in certain embodiments of the invention, such an omission generally would require insertion member 136 to connect to the remainder of attachment device 120 from its top surface which, in turn, generally would allow merchandise assembly 100 to pivot within opening 52. As shown in the drawings, slot 54 preferably has a funnel shape, which allows insertion member 136 to be initially inserted into opening 52 at nearly any angle and still cause pocket portion 129 (or some other narrower portion just past insertion member 136) to be guided into the narrower portion of slot 54.

Later, the item of merchandise 105 can at any time simply be lifted up to again remove it from the receptacle 40 or 44. In short, the combination of display apparatus 10 and attachment device 120 generally allows for easy and convenient display, removal and replacement of a variety of merchandise items 105, particularly elongated items 105 or other items 105 having a non-standard shape.

In the embodiment described above, two receptacles 40 and 44 are used and are rotationally offset from each other so that their openings are as far apart as possible. As a result, additional items 105 often can be held by display apparatus 10. However, in alternate embodiments, only a single receptacle 40 or more than two receptacles are used. Whenever multiple receptacles are used on a vertical pole supporting structure, it is preferred that they be rotationally offset from each other and fixedly attached to each other so that all can be turned simultaneously. However, in alternate embodiments each receptacle 40 is capable of turning independently of the other(s).

Also, in the various embodiments of the invention, the openings 52 (relative to the remainder of receptacle 40) and/or the insertion members 136 (relative to the remainder of the attachment device 120) can be oriented at a variety of different angles, which may be identical across all openings 52 and across all insertion members 136, or may be varied from opening 52 to opening 52 or from insertion member 136 to insertion member 136, so as to create correspondingly different visual effects for the displayed items of merchandise 105. However, in the event that it is desired to vary the angles at which the items of merchandise 105 are displayed, it generally will be preferable to vary the angles of the openings 52 and keep constant the angles of the insertion members 136. For similar purposes, it is possible to use multiple receptacles 40 and 44 having differently angled openings 52.

In the specific embodiment described above, the insertion member 136 and matching opening 52 are tapered and in the general shape of an inverted cone. In alternate embodiments, other shapes are used. For example, in certain embodiments the insertion member 136 is shaped as a "J", a hook, or an inverted tripod, and/or has a cross-section in the shape of a star, a plus sign or a "T". In any event, the insertion member 136 and opening 52 preferably match in shape so that the insertion member 136 fits securely within and/or does not move appreciably within opening 52; as a result, the attached articles of merchandise often can be held in a desired position and orientation, e.g., to achieve the best visual effects and/or to prevent the individual articles of merchandise from contacting each other (thereby minimizing scratching, etc.). Also, irrespective of the particular shape, the insertion member 136 preferably is tapered, e.g., so as to facilitate placement within an opening 52.

Although the foregoing embodiments primarily use an example in which walking canes are displayed, other items of merchandise 105 instead may be displayed using a display system according to the present invention. Examples include fishing poles, gaffs, snorkels, fins/flippers, ski poles, skis, golf clubs/putters, pool cues, tennis/badminton rackets, hockey sticks, baseball bats, swords, rifle scopes, drum sticks, tripods, umbrellas, garden tools/trimmers, large restaurant kitchen utensils, brooms, mops, T squares and carpenter levels.

In the embodiments described above, each item of merchandise 105 is provided with a single attachment device 120. However, in alternate embodiments multiple attachment devices 120 are provided on a single item of merchandise 105, e.g., with the corresponding multiple insertion members 136 being inserted into corresponding multiple openings 52; in one such embodiment, two attachment devices 120 are provided along the length of a single item of merchandise 105, with one of the corresponding insertion members 136 fitting into an opening 52 in the lower receptacle 44 and the other insertion member 136 fitting into an opening 52 in the upper receptacle 40. In such embodiments, the fastening portions 124 can be different on the different attachment devices 120; for example, one fastening portion 124 might be used to inhibit horizontal movement of the item 105, while another might be used to inhibit vertical movement; similarly, one of the attachment devices 120 might use a guide (e.g., a "U"-shaped groove), i.e., one that is not tightly secured to the item 105, instead of a fastening portion 124, while the other of the attachment devices 120 includes a fastening portion 124 of the type described above (which provides a secure attachment to the item 105). Items 105 that could benefit from the use of multiple attachment devices 120 include, e.g., boogie boards, skateboards and snowboards.

Additional Considerations.

As used herein, the terms "vertical" and "horizontal" are used in a relative rather than absolute sense unless clearly and expressly stated to the contrary. Thus, an item described as being oriented vertically generally is one that is primarily vertical, i.e., within 45° of a perfect vertical orientation, and one that is described as being oriented horizontally generally is one that is primarily horizontal, i.e., within 45° of a perfect horizontal orientation.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

The terms "may" and "generally" when used herein in conjunction with "is(are)" and verbs are meant to communicate the intention that the description is exemplary and believed to be broad enough to encompass both the specific examples presented in the disclosure as well as alternative examples that could be derived based on the disclosure. The terms "may" and "generally" as used herein should not be construed to necessarily imply the desirability or possibility of omitting a corresponding element.

While the invention has been particularly shown and described with reference to embodiments thereof, it will be understood by those skilled in the art that various changes in form and details may be made without departing from the scope of the invention.

The invention claimed is:

1. An apparatus comprising:

a center slot configured to physically connect to a support structure; and a plurality of openings around a periphery of said apparatus, each of said openings (a) comprising a vertical slot and an elongated cavity and (b) configured to removably accept an attachment device, wherein (i) said elongated cavity is tapered from top to bottom, (ii) an insertion member that is tapered from a top of said attachment device to a bottom of said attachment device is accepted by one of said plurality of openings to fit in said elongated cavity and (iii) a segment of said attachment device is configured to pass through said vertical slot when said insertion member is inserted into said elongated cavity.

2. The apparatus according to claim 1, wherein said apparatus is implemented by an injection mold.

3. The apparatus according to claim 1, wherein said apparatus comprises ten of said openings.

4. The apparatus according to claim 1, wherein said center slot comprises a notch configured to fit with a tab of a piece of said support structure.

5. The apparatus according to claim 4, wherein said apparatus and said piece are configured to rotate about said support structure.

6. The apparatus according to claim 4, wherein said apparatus comprises a second notch and said second notch is offset from said notch.

7. The apparatus according to claim 1, wherein a first of said apparatuses and a second of said apparatuses are configured to connect to said support structure.

* * * * *